United States Patent [19]

Swisher, Jr. et al.

[11] 4,335,921

[45] Jun. 22, 1982

[54] CUTTING HEAD FOR A PAVED ROADWAY RESURFACING APPARATUS

[75] Inventors: George W. Swisher, Jr.; Thomas L. Steele, both of Oklahoma City, Okla.

[73] Assignee: CMI Corporation, Oklahoma City, Okla.

[21] Appl. No.: 19,470

[22] Filed: Mar. 12, 1979

Related U.S. Application Data

[63] Continuation of Ser. No. 803,559, Jun. 6, 1977, abandoned.

[51] Int. Cl.[3] ..... E21C 35/18

[52] U.S. Cl. ..... 299/86; 299/92

[58] Field of Search ..... 299/79, 91, 92, 86

[56] References Cited

U.S. PATENT DOCUMENTS

| | | | |
|---|---|---|---|
| 2,907,559 | 10/1959 | Brown | 299/92 |
| 2,916,275 | 12/1959 | Bruestle | 299/92 |
| 2,989,295 | 6/1961 | Prox, Jr. | 299/79 |
| 3,063,691 | 11/1962 | Osgood | 299/92 |
| 3,499,685 | 3/1970 | Kniff | 299/92 |
| 3,622,206 | 12/1959 | Krekeler et al. | 299/92 |
| 3,841,709 | 10/1974 | Kniff | 299/91 |
| 3,856,359 | 12/1974 | Krekeler | 299/92 |

FOREIGN PATENT DOCUMENTS

| | | | |
|---|---|---|---|
| 1805397 | 5/1970 | Fed. Rep. of Germany | 299/91 |

*Primary Examiner*—William F. Pate, III

*Attorney, Agent, or Firm*—Dunlap & Codding

[57] ABSTRACT

A cutting head for a paved roadway resurfacing apparatus comprising a support block having a shoulder and a cutter having a shoulder mating with the shoulder on the support block to prevent rotation of the cutter with respect to the support block.

4 Claims, 11 Drawing Figures

CUTTING HEAD FOR A PAVED ROADWAY RESURFACING APPARATUS

CROSS REFERENCE TO RELATED APPLICATIONS

This is a continuation of application Ser. No. 803,559, filed June 6, 1977, now abandoned.

The subject matter of the present application is related to the subject matter disclosed in copending U.S. patent application Ser. No. 672,326, filed Mar. 31, 1976, entitled "A METHOD AND APPARATUS FOR PLANING A PAVED ROADWAY," and assigned to the assignee of the present invention, and to copending U.S. patent application Ser. No. 765,869, filed Feb. 4, 1977, entitled "A METHOD AND APPARATUS FOR RESURFACING A PAVED ROADWAY" and also assigned to the assignee of the present invention.

BACKGROUND OF THE INVENTION

1. Field of the Invention

The present invention relates generally to cutting tools and more particularly, but not by way of limitation, to cutting tools used in roadway resurfacing machines.

2. Description of the Prior Art

In the course of time, the effects of traffic and weather on paved roadways result in the development of cracks, pot holes and the like so that roadways are continually maintained and repaired. For a time after a roadway is constructed, this maintenance may consist of nothing more than simply patching defects as they appear; for example, pot holes may be filled with asphalt. Eventually, however, such minor repair will be insufficient to restore a roadway to reasonable condition. In the past, it has been common to deposit a new layer of paving material on the roadway when such a condition is reached. Numerous roadways in the United States, both highways and city streets, have been relayered a number of times.

While relayering is an effective means of extending the lifetime of a paved roadway, the process cannot be continued indefinitely. Eventually, the roadway will be built up to a level which makes relayering impractical. Moreover, if the relayering is carried out on a roadway having pot holes, the new surface will not distribute a load thereon as evenly as the surface of a newly constructed roadway so that deterioration of the roadway occurs at an accelerated rate. To counter these problems, resurfacing machines have been developed to remove layers of paving materials rather than to deposit new layers. These machines provide a number of advantages in the art of roadway maintenance. For example, the roadway may be usable in the condition in which it is left by the resurfacing machine so that resurfacing results in a direct extension of the lifetime of the roadway. Such a result is not uncommon where many layers of asphalt have been deposited on a roadway over a number of years.

Even where the roadway will not be usable in the condition in which it is left by a resurfacing machine, it is nevertheless advantageous to resurface the roadway as an intermediate step to relayering. By removing internal defects, a better load distributing capacity may be achieved to extend the lifetime of the newly deposited surface and, since the resurfacing operation leaves an even surface for the new layer, the layer may be thinner than would be required were the roadway not resurfaced prior to relayering. The resulting savings in both money and resources justify the cost of resurfacing.

The manner in which roadways have been constructed in the past has presented a problem in the use of the resurfacing machines so that the potential savings offered by these machines may not be fully achieved. Roadways are commonly constructed of either asphalt or concrete. Experience has shown that the requirements of asphalt and concrete roadway resurfacing differ.

In general, a roadway resurfacing machine incorporates a drum having a flight wrapped spirally thereabout. A number of cutting heads are attached to the flight and the drum is rotated as the machine is moved along the roadway so that cutters, forming a part of the cutting heads, are driven into and cut away portions of the roadway. It will be recognized that the forces existing between the roadway and the cutters will be quite large. Since these forces are exerted on a leading edge of the cutter, the cutter tends to twist in its holder so that a rotatably mounted cutter undergoes auto-rotation as it cuts away the surface of a roadway.

It has been found that auto-rotation of cutters having conically shaped bits is advantageous when the roadway being resurfaced is made of concrete. The texture of the resulting surface has desirable characteristics both in terms of use as is and in terms of relayering. Moreover, the bits are not subject to excessive wear so that the cost of resurfacing is maintained at a reasonable value.

A different situation obtains when an asphalt roadway is resurfaced. The auto-rotation of the cutters and the shape of the bits result in excessive wear of portions of the cutters to which the bits are attached. For asphalt roadways, non-rotating spade type bits; that is, rectangular bits having a cutting edge formed along one side, have been found to be advantageous. The wear rate of such cutters is well within acceptable limits and the resulting surface is suitably textured.

SUMMARY OF THE PRESENT INVENTION

The present invention provides roadway resurfacing machines with the capability of selecting either rotating or non-rotating cutters. For this purpose, the cutting heads on the machine comprise support blocks having circular bores and at least one shoulder positioned such that a cutter designed for auto-rotation will clear the shoulder. Cutters designed for use in a non-rotating mode are provided with lugs, forming shoulders which mate with the shoulders on the support blocks, to prevent auto-rotation. The cutters are held on the support blocks by spring clips so that replacement of one type of cutter with another type of cutter may be carried out easily and rapidly in the field.

An object of the present invention is to provide a roadway resurfacing machine with a selectivity of cutters, permitting efficient operation on both asphalt and concrete roadways.

Another object of the invention is to provide a roadway resurfacing machine with non-rotating cutters while maintaining the capability of the machine to use rotating cutters.

A further object of the invention is to provide a roadway resurfacing machine with non-rotating cutters suitable for use on asphalt roadways.

Other objects, advantages and features of the present invention will become clear from the following detailed description of the invention when read in conjunction with the drawings, wherein like items have been designated with like numbers, and with the appended claims.

DESCRIPTION OF THE PREFERRED EMBODIMENT

Figure 1:
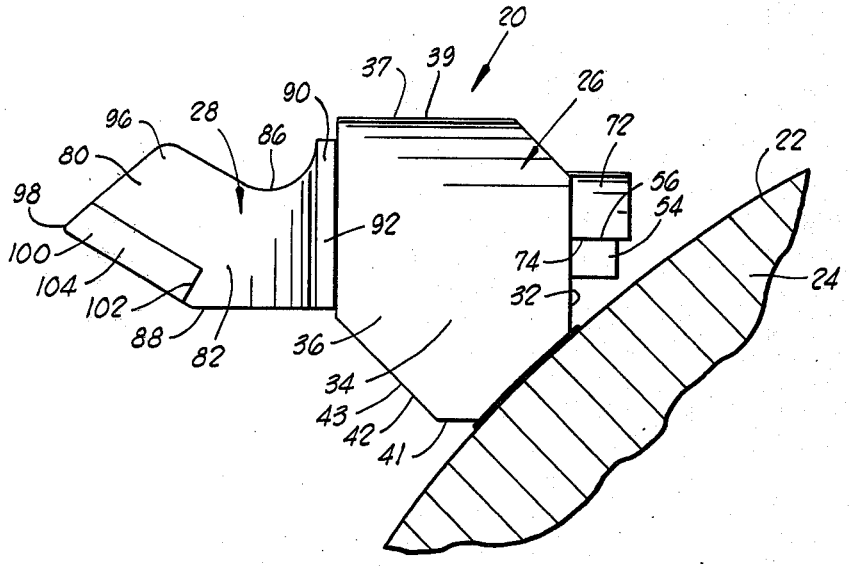
FIG. 1 is a side elevation view of a preferred embodiment of the cutting head of the present invention.
Figure 2:
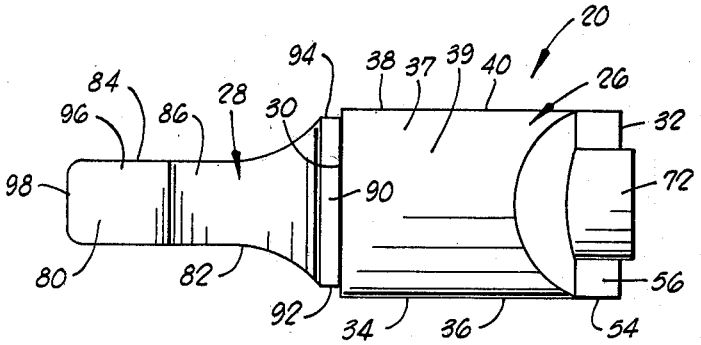
FIG. 2 is a plan view of the cutting head of FIG. 1.
Figure 3:
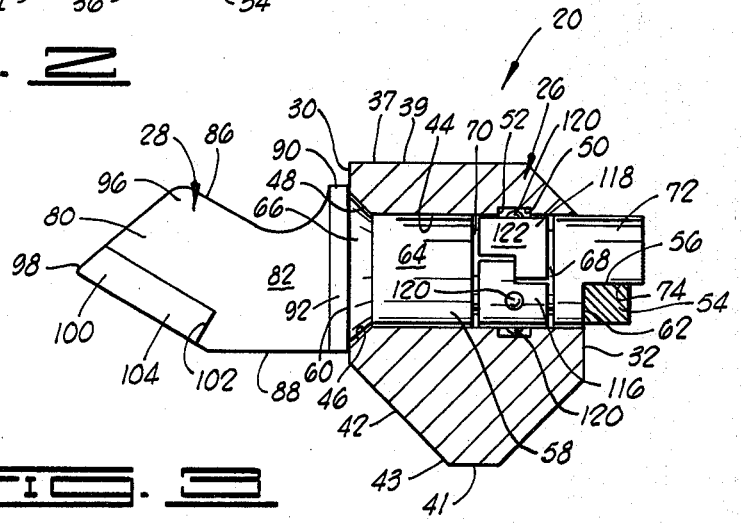
FIG. 3 is a side elevation view of the cutting head of FIG. 1 in partial cross-section.

Referring now to the drawings and to FIGS. 1, 2 and 3 in particular, shown therein and designated by the general reference numeral 20 is a preferred embodiment of the present invention. In use, the cutting head 20 is mounted on the edge 22 of the helicoid flight 24 spirally wrapped on a drum (not shown) which, in turn, is rotatably mounted on a resurfacing machine (not shown). Portions of the cutting head 20 may be driven into a paved surface to cut away a portion thereof by rotating and translating the drum (not shown).

The cutting head 20 generally comprises a support block 26 and a cutter 28 supported thereby as will be discussed hereinbelow. The support block 26 has a first end 30, a second end 32, a first side 34, generally disposed on a first side 36 of the cutting head 20, and a second side 38, generally disposed on a second side 40 of the cutting head 20. The support block 26 also has a top 37, generally disposed at a top 39 of the cutting head 20, and a bottom 41, generally disposed at a bottom 43 of the cutting head 20. An oblique face 42 is formed on portions of the support block 26 near the first end 30 thereof such that the oblique face 42 intersects the first end 30 at an obtuse angle and slopes away therefrom in a direction generally toward the second end 32 of the support block 26.

As more clearly shown in FIG. 3, a cutter support bore 44 is formed in the support block 26, the cutter support bore 44 intersecting the first end 30 and the second end 32 and extending therebetween. The cutter support bore 44 is generally circular in cross-section and has a conically shaped portion 46 adjacent the first end 30, the portion 46 forming a bearing face 48 to provide longitudinal support for the cutter 28 when the cutter 28 is driven into a paved roadway.

A portion 50 of the cutter support bore 44, generally near the second end 32 of the support block 26, is enlarged so that the cutter support bore 50 is provided with an internal shoulder 52. The purpose of the shoulder 52 will be discussed hereinbelow.

A portion 54 of the support block 26 is formed in a partial occluding relation with the cutter support bore 44 adjacent the second end 32 of the support block 26. The portion 54 has an upper face 56 extending axially with respect to the cutter support bore 44 and substantially bisecting the intersection of the cutter support bore 44 with the second end 32 of the support block 26 so that the portion 54 forms a support block shoulder on the support block 26 for a purpose which will be discussed in more detail below. The portion 54 may be conveniently formed on the support block 26 by welding a length of square steel rod to the second end 32 of the support block 26.

The cutter 28 generally comprises a shank 58 having a first end 60, a second end 62 and a peripheral surface 64. The shank 58 is generally circular in cross-section and has a frustum shaped portion 66 adjacent the first end 60. As will be described more fully below, the cutter 28 may be readily mounted on the support block 26 to place the cutting head 20 in an assembled mode thereof as illustrated in the drawings. In the assembled mode, the shank 58 mates with the cutter support bore 44, as illustrated in the drawings, with the frustum shaped portion 66 engaging the bearing face 48 to provide longitudinal support for the cutter 28.

A reduced portion 68 is formed in the shank 58 to form a groove 70 extending circularly about the shank 58. The groove 70 is wider than the enlarged portion 50 of the cutter support bore 44 and is formed generally near the second end 62 of the shank 58 such that, in the assembled mode of the cutting head 20, the groove 70 is longitudinally aligned with the enlarged portion 50 of the cutter support bore 44 and extends generally longitudinally symmetrically thereabout. The purpose of the groove 70 will be discussed more fully hereinbelow.

An axial lug 72 is joined to the second end 62 of the shank 58 and extends substantially axially therefrom with respect to the shank 58. The axial lug 72 is substantially semi-circular in cross-section to provide the cutter 28 with a face 74 such that a cutter shoulder is formed on the cutter 28 by the axial lug 72. The axial lug 72 is circularly positioned on the shank 58 such that, in the assembled mode of the cutting head 20, the shoulder formed by the axial lug 72 mates with the shoulder formed by the face 56 on the portion 54 of the support block 26 partially occluding the cutter support bore 44. The axial lug 72 may be conveniently joined to the shank 58 by, for example, welding the axial lug 72 thereto or by forming the axial lug 72 unitarily with the shank 58; that is, by constructing the shank 58 and the axial lug 72 from a single piece of material.

The cutter 28 further comprises a chisel 80 attached to the first end 60 of the shank 58 and extending generally axially therefrom. The chisel 80 has a first side 82, a second side 84, a top 86 and a bottom 88. In the assembled mode of the cutting head 20, illustrated in the drawings, the first and second sides, 82 and 84 respectively, of the chisel 80 are disposed on the first and second sides, 36 and 40 respectively, of the cutting head 20. The top and bottom, 86 and 88 respectively, of the chisel 80 are disposed at the top and bottom, 39 and 41 respectively, of the cutting head 20.

A substantially square portion 90 is formed on the chisel 80 adjacent the shank 58 and the square portion 90 has a first lateral face 92 and a second lateral face 94. In the assembled mode of the cutting head 20, the first lateral face 92 is disposed on the first side 36 of the cutting head 20 and the second lateral face 94 is disposed on the second side 40 of the cutting tool 20. A blade portion 96 extends from the square portion 90 in a direction generally axial with respect to the shank 58, the shank 58 and the blade portion 96 extending in generally opposing directions with respect to the square portion 90.

The chisel 80 terminates in a forward end 98 and is provided with a spade type cutting point 100 as will now be described. A substantially rectangular shoulder 102 is formed near the forward end 98 of the chisel 90 and the shoulder 102 extends across the chisel 90 to intersect the first side 82 and the second side 84 thereof. A substantially rectangular tungsten carbide bit 104 is fixed within the shoulder 102 to provide the cutting point 100.

The cutting head 20 is further provided with a spring clip 116 disposed within the groove 70 in the shank 58. The clip 116 comprises a split ring 118 having a plurality of hemispherical protrusions 120 extending radially outwardly from the peripheral surface 122 thereof.

OPERATION OF THE PREFERRED EMBODIMENT

It is contemplated that the support blocks 26 form a permanent portion of a paved roadway resurfacing machine. The cutting heads 20 are attached to the machine as illustrated in FIG. 1, via attaching the support blocks 26 to the helicoid flight 24 on the drum (not shown) of the machine (not shown). Such attachment may be conveniently carried out by welding the support blocks 26 to the helicoid flight 24. It is further contemplated that the machine will be provided with two sets of cutters for use with support blocks 26, one set consisting of a number of cutters 28 of the present invention equal to the number of support blocks 26 which have been welded to the helicoid flight 24. The second set of cutters (not shown) consists of an equal number of cutters provided without axial lugs 72 and provided with conical cutting points in place of the spade type cutting points 100 of the cutters 28 of the present invention. As has been previously noted, the cutter used with a paved roadway resurfacing machine has a natural tendency to undergo auto-rotation. Since the second set of cutters are provided without axial lugs 72 to prevent such rotation, auto-rotation of the second set of cutters will occur.

When a paved roadway resurfacing machine is used on a concrete surface, the second set of cutters (not shown) will be mounted on support blocks 26 so that auto-rotation of the cutters may be caused to occur during the resurfacing of concrete surfaces. Experience has shown that auto-rotation will result in a reasonable wear rate of the cutters and that the resurfaced roadway will be textured and scarrified in a manner which, in many cases, will be suitable for traffic without further reconstruction of the roadway.

When the machine is moved to a new location wherein an asphalt roadway is to be resurfaced, the rotating cutters are replaced with the cutters 28 as will now be described. Initially, it will be noted that all cutters used in conjunction with the support block 26 have shanks identical to the shank 58 and are provided with spring clips to the spring clip 116. Accordingly, the removal of rotating cutters will be described with reference to FIG. 3.

In the assembled mode of a cutting head, whether the cutting head incorporates a rotating cutter or is the assembled cutting head 20, the hemispherical protrusions 120 of the spring clip 116 are disposed within the enlarged portion 50 of the cutter support bore 44 so that the protrusions 120 and the internal shoulder 52 cooperate to maintain the cutting head in the assembled mode. Removal of a cutter is accomplished by driving the shank 58 toward the first end 30 of the support block 26 by placing a punch or the like against the second end 62 of the shank 58 and striking the punch with a mallet or the like. (It will be recognized that, when the cutter 28 is mounted on the support block 26, the punch will be placed against the axial lug 72.) As the shank 58 is driven toward the first end 30 of the support block 26, the protrusions 120 engage the internal shoulder 52 and are forced radially inwardly thereby to collapse the split ring 118 so that the shank 58 may be driven from the cutter support bore 44.

The cutting head 20 is assembled by driving the shank 58 of a cutter 28, having a spring clip 116 mounted thereon, into the cutter support bore 44. The shank 58 is introduced into the cutter support bore 44 and the axial lug 72 is circularly positioned therein such that the axial lug 72 is opposed to the non-occluded portion of the cutter support bore 44 at the second end 32 of the support block 26. The cutter 28 is then seated by striking the forward end 98 of the chisel 80 with a mallet or the like to drive the shank 58 into the cutter support bore 44. The hemispherical protrusions 120 engage the bearing face 48 and are forced radially inwardly thereby to collapse the split ring 118 so that the shank 58 may be driven to a position wherein the frustum shaped portion 66 of the shank 68 engages the bearing face 48. At this position, the protrusions 120 are aligned with the enlarged portion 50 of the cutter support bore 44 so that the split ring 118 expands to position the protrusions 120 within the enlarged portion 50. The protrusions 120 and the internal shoulder 52 cooperate to retain the cutting head 20 in the resulting assembled mode thereof.

Resurfacing of the asphalt roadway then proceeds by rotating the drum (not shown) upon which the helicoid flight 24 and cutting heads 20 are mounted while the drum is moved along the roadway. Although forces between the cutting point 100 of the chisel 80 in the roadway will, as in the case of the rotating cutters, tend to cause auto-rotation of the cutter 28, the shoulder formed by the face 74 on the axial lug 72 will mate with the shoulder formed by face 56 on the portion 54 of the support block 26 to prevent such auto-rotation.

Figure 4:
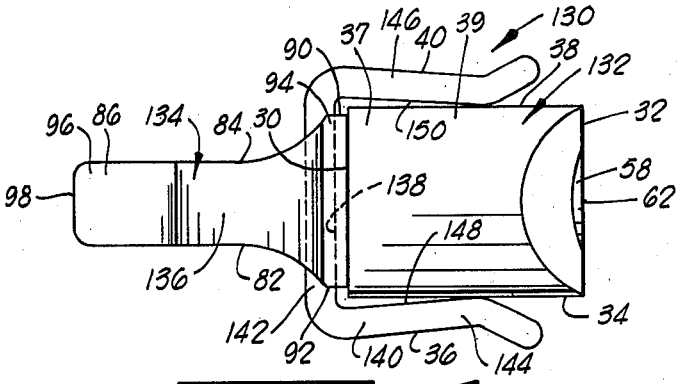
FIG. 4 is a plan view of a second embodiment of the present invention.
Figure 5:
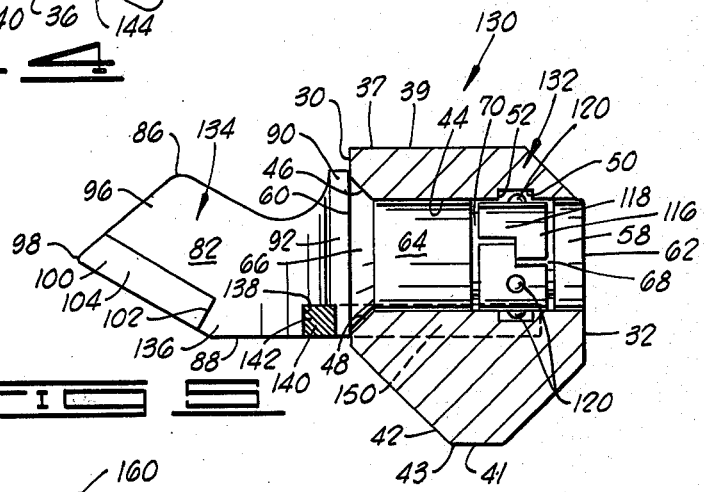
FIG. 5 is a side elevation view of the cutting head of FIG. 4 in partial cross-section.

DESCRIPTION OF FIGS. 4 and 5

Referring now to FIGS. 4 and 5, shown therein and designated by the reference numeral 130 is a second embodiment of the cutting head of the present invention. The cutting head 130 generally comprises a support block 132 which is identical to the support block 26 except that the portion 54 of the support block 26 is not included in the support block 132. The cutting head 130 further includes a cutter 134 having a shank 58 and a chisel 136. The chisel 136 is identical to the chisel 80 except that a transverse channel 138, having a substantially square cross-section, is formed in the bottom 88 of chisel 136, the channel 138 extending across the chisel 136 and intersecting the first and second sides, 82 and 84 respectively, thereof. The cutter 134 further comprises a yoke 140 formed of square steel rod of a size to mate with the channel 138. The yoke 140 is secured within the channel 138 by, for example, welding a base portion 142 of the yoke 140 therewithin. A portion of the yoke 140 forms a first lateral positioning lug, connected to the base portion 142 on the first side 82 of the chisel 136 and extending therefrom toward the second end 62 of the shank 58 such that the portion 144 of the yoke 140 forms a first lateral cutter shoulder. Another portion 146 of the yoke 140 forms a second lateral positioning lug, connected to the base portion 142 on the second side 84 of the chisel 136 and extending therefrom toward the second end 62 of the shank 58 such that the portion 146 of the yoke 140 forms a second lateral cutter shoulder.

The first side 34 of the support block 132 cooperates with the first end 30 of the support block 132 to form a first lateral support block shoulder and the second side 38 cooperates with the first end 30 to form a second lateral support block shoulder. The length of the base portion 142 of the yoke 140 is selected such that the separation of the lateral cutter shoulders formed by the portions 144 and 146 of the yoke 140 are separated by a distance substantially equal to the distance between the support block shoulders formed by the sides 34 and 38 of the support block 132.

A first lateral face 148 of the portion 144 of the yoke 140 engages the first side 34 of the support block 132 in the assembled mode of the cutting head 130 so that the first lateral cutter shoulder mates with the first lateral support block shoulder. A second lateral face 150 of the portion 146 of the yoke 140 engages the second side 38 so that the second lateral cutter shoulder mates with the second lateral support block shoulder in the assembled mode of the cutting head 130.

The operation of the cutting head 130 differs from that of the cutting head 20 only in the manner in which auto-rotation is prevented. The cutting head 20 utilizes the cutter shoulder formed by the axial lug 72 for this purpose while the cutting head 130 utilizes the lateral cutter shoulders formed by the portions 144 and 146 of the yoke 140.

Figure 6:
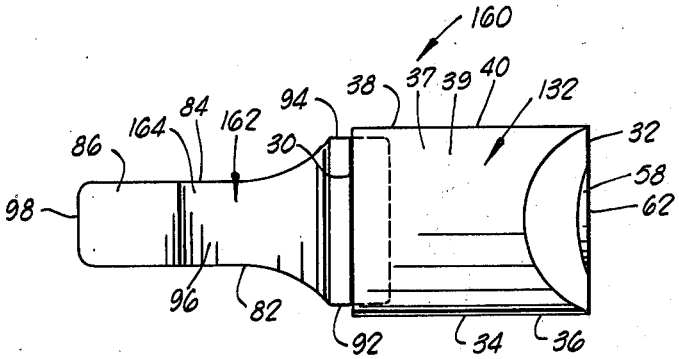
FIG. 6 is a plan view of a third embodiment of the present invention.
Figure 7:
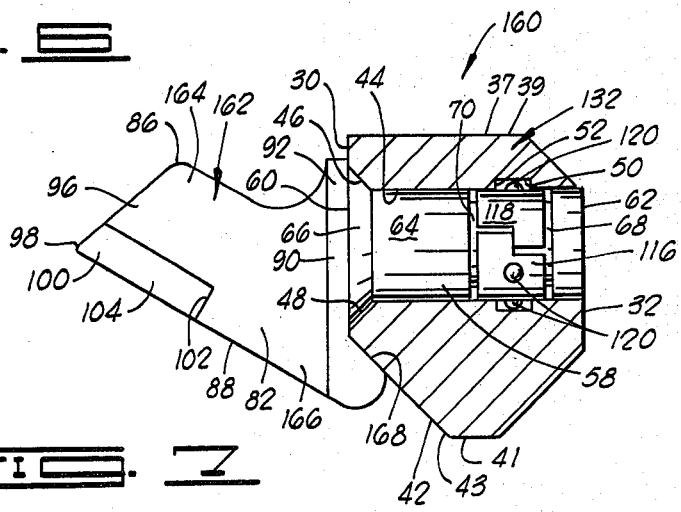
FIG. 7 is a side elevation view of the cutting head in FIG. 6 in partial cross-section.

DESCRIPTION OF FIGS. 6 and 7

Referring now to FIGS. 6 and 7, shown therein and designated by the general reference numeral 160 is a third embodiment of the cutting head of the present invention. The cutting head 160 generally comprises a support block 132 and a cutter 162 having a shank 58 and a chisel 164 differing from the chisel 80 only as will now be described. A portion 166 of the chisel 164, adjacent the bottom 88 thereof, has been extended to form a positioning lug extending obliquely from the blade portion 96 of the chisel 164. An oblique face 168 formed on the portion 166 provides the cutter 162 with a cutter shoulder. The oblique face 42 of the support block 132 forms an oblique shoulder mating with the shoulder formed on the portion 166 of the chisel 164 in the assembled mode of the cutting head 160. The operation of the cutting head 160 differs from the operation of the cutting head 20 only in that the cutting head 160 utilizes the shoulder formed on the portion 166 of the chisel 164 to prevent auto-rotation of the cutting head 160 whereas the cutting head 20 utilizes the axial lug 72 for this purpose.

Figure 8:
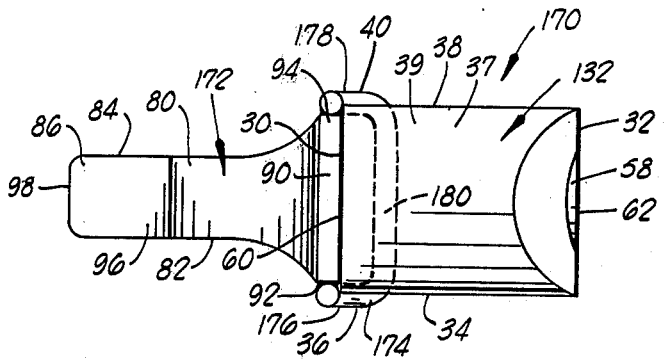
FIG. 8 is a plan view of a fourth embodiment of the present invention.
Figure 9:
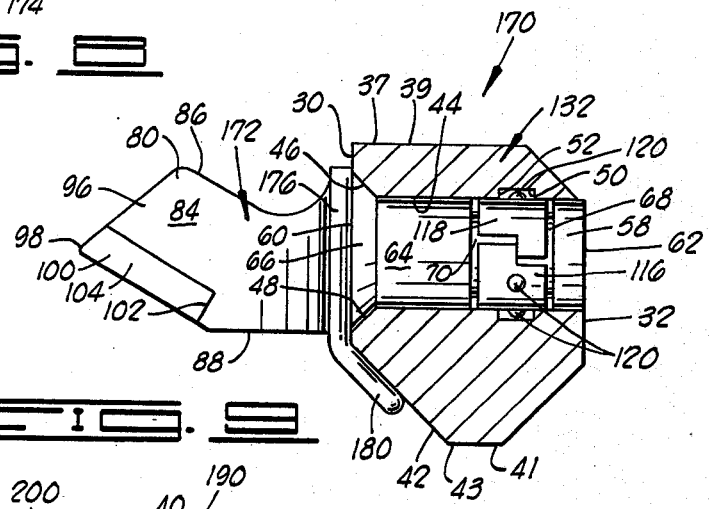
FIG. 9 is a side elevation view of the cutting head of FIG. 8 in partial cross-section.

DESCRIPTION OF FIGS. 8 and 9

FIGS. 8 and 9 illustrate a fourth embodiment, designated by the general reference numeral 170, of the cutting head of the present invention. The cutting head 170 generally comprises a support block 132 and a cutter 172 having a shank 58 and a chisel 80. The cutter 172 further comprises a yoke 174 having a first tine portion 176 and a second tine portion 178. The first tine portion is attached to the first lateral face of the square portion 90 of the chisel 80 and the second tine portion 178 is attached to the second lateral face 94 of the square portion 90 of the chisel 80. The yoke 174 has a U-shaped portion 180, connected to the tine portions 176 and 178, and extending beyond the bottom 88 of the chisel 80 to form a positioning lug. The U-shaped portion 180 is bent generally toward the second end 62 of the shank 58 to form a cutter shoulder. In the assembled mode of the cutting head 170, the shoulder formed by the U-shaped portion 180 of the yoke 174 mates with the support block shoulder formed by the oblique face 42 of the support block 132. The operation of the cutting head 170 is identical to the operation of the cutting head 160.

Figure 10:
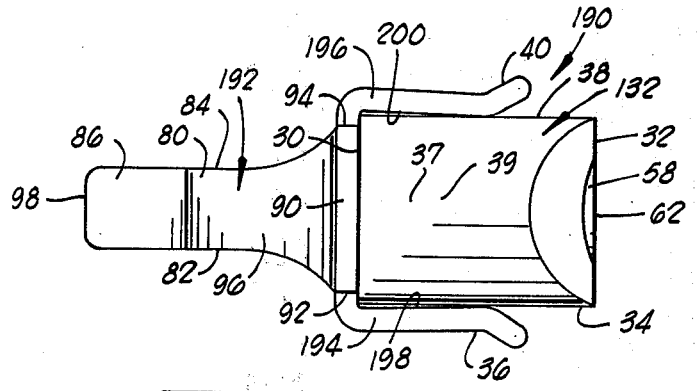
FIG. 10 is a plan view of a fifth embodiment of the present invention.
Figure 11:
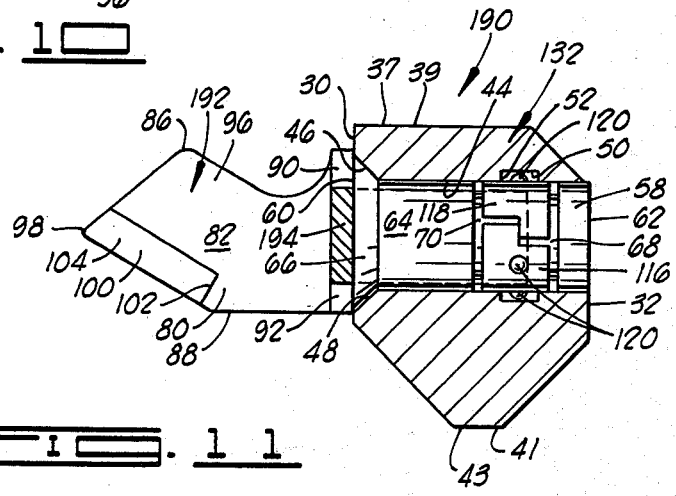
FIG. 11 is a side elevation view of the cutting head of FIG. 10 in partial cross-section.

DESCRIPTION OF FIGS. 10 and 11

A fifth embodiment of the cutting head of the present invention is illustrated in FIGS. 10 and 11 and designated therein by the general reference numeral 190. The cutting head 190 generally includes a support block 132 and a cutter 192 comprising a shank 58 and a chisel 80. The cutter 192 comprises a first lateral positioning lug 194, attached to the first lateral face 92 of the square portion 90 of the chisel 80 and extending therefrom toward the second end 62 of the shank 58 to form a first lateral cutter shoulder. The cutter 192 further comprises a second lateral positioning lug 196, attached to the second lateral face 94 of the square portion 90 and extending therefrom toward the second end 62 of the shank 58 to form a second lateral cutter shoulder.

The first side 34 of the support block 132 cooperates with the first end 30 thereof to form a first lateral support block shoulder. A first lateral face 198 on the first lateral positioning lug 194 engages the first side 34 of the support block 132 in the assembled mode of the cutting head 190 such that the shoulder formed by the first lateral positioning lug 194 mates with the shoulder formed by the first side 34 of the support block 132. The second side 38 of the support block 132 cooperates with the first end 30 thereof to form a second lateral support block shoulder. A second lateral face 200 on the second lateral positioning lug 196 engages the second side 38 of the support block 132 in the assembled mode of the cutting head 190 such that the shoulder formed by the second lateral positioning lug 196 mates with the shoulder formed by the second side 38 of the support block 132. The operation of the cutting head 190 is identical to the operation of the cutting head 130.

It is clear that the present invention is adapted to carry out the objects and attain the ends and advantages mentioned as well as those inherent therein. While a number of presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. The combination of a support block having an external surface and usuable with a first cutter desired to be nonrotatably mated with the support block and a second cutter desired to be rotatably mated with the support block, wherein:

the support block has a substantially circular bore therethrough intersecting the external surface of the support block at a first end and at a second end of the support block and extending therebetween, wherein the circularity of said bore is maintained between said first end and said second end, wherein the support block is characterized as having shoulder means on the external surface thereof, and wherein the shoulder means of the support block is formed by a portion thereof disposed on the second end thereof, said portion partially occluding the bore extending through the support block;

the first cutter has a shank sized to rotatably mate with said bore and has shoulder means thereon sized and arranged to mate with the support block shoulder means when the shank of the first cutter is mated with the bore of the support block, both of said shoulder means being located and arranged to prevent rotation of the first cutter when the shank of the first cutter is in said bore, wherein the shank of the first cutter has a first end adjacent the first end of the support block and a second end adjacent the second end of the support block when the shank of said first cutter is mated with the bore of the support block and wherein the first cutter includes an axial lug connected to the second end of the shank and protruding from the bore formed through the support block to engage the shoulder means on the support block; and the second cutter has a shank sized to rotatably mate with said bore and no shoulder means engaging the support block shoulder means when the shank of the second cutter is mated with the bore of the support block, whereby the second cutter will rotate in the support block.

2. The combination of a support block having an external surface and usable with a first cutter desired to be nonrotatably mated with the support block and a second cutter desired to be rotatably mated with the support block, wherein:

the support block has a substantially circular bore therethrough intersecting the external surface of the support block at a first end and at a second end of the support block and extending therebetween, wherein the circularity of said bore is maintained between said first end and said second end, wherein the support block is characterized as having shoulder means on the external surface thereof, and wherein the support block is characterized as having formed thereon an oblique face intersecting the first end of the support block and extending therefrom at an angle to the axis of the bore to form the shoulder means on the support block, said oblique face extending generally toward the second end of the support block and away from the bore formed through the support block;

the first cutter has a shank sized to rotatably mate with said bore and has shoulder means thereon sized and arranged to mate with the support block shoulder means when the shank of the first cutter is mated with the bore of the support block, both of said shoulder means being located and arranged to prevent rotation of the first cutter when the shank of the first cutter is in said bore, wherein the first cutter includes:

a chisel connected to one end of the shank of the first cutter and extending from the first end of the support block in a direction generally opposite the direction of the first end of the support block to the second end thereof when the shank of the first cutter is mated with the bore of the support block; and a positioning lug connected to the chisel and having formed thereon the cutter shoulder means mating with the shoulder means on the support block when the shank of the first cutter is mated with the bore of the support block, the positioning lug being characterized as being a portion of a yoke having a first tine portion connected to one side of the chisel and a second tine portion connected to the opposite side of the chisel; and the second cutter has a shank sized to rotatably mate with said bore and no shoulder means engaging the support block shoulder means when the shank of the second cutter is mated with the bore of the support block, whereby the second cutter will rotate in the support block.

3. The combination of a support block having an external surface and usable with a first cutter desired to be nonrotatably mated with the support block and a second cutter desired to be rotatably mated with the support block, wherein:

the support block has a substantially circular bore therethrough intersecting the external surface of the support block at a first end and at a second end of the support block and extending therebetween, wherein the circularity of said bore is maintained between said first end and said second end, wherein the support block is characterized as having shoulder means on the external surface thereof, and wherein the shoulder means of the support block is characterized as being two shoulders formed on the external surface thereof, said shoulders formed by a first side of the support block and an opposed second side thereof;

the first cutter has a shank sized to rotatably mate with said bore and has shoulder means thereon sized and arranged to mate with the support block shoulder means when the shank of the first cutter is mated with the bore of the support block, both of said shoulder means being located and arranged to prevent rotation of the first cutter when the shank of the first cutter is in said bore, wherein the first cutter includes:

a chisel, connected to one end of the shank of the first cutter and extending from the first end of the support block in a direction generally opposite the direction from the first end of the support block to the second end thereof when the shank of the first cutter is mated with the bore of the support block;

a first positioning lug mounted on the first cutter via the chisel and forming a first shoulder mating with the shoulder of the support block formed by the first side of the support block; and a second positioning lug mounted on the first cutter via the chisel and forming a second shoulder mating with the shoulder of the support block formed by the second side thereof; and the second cutter has a shank sized to rotatably mate with said bore and no shoulder means engaging the support block shoulder means when the shank of the second cutter is mated with the bore of the support block, whereby the second cutter will rotate in the support block.

4. The combination of claim 3 wherein the first positioning lug and the second positioning lug are characterized as being portions of a yoke.

* * * * *